United States Patent [19]

Lowe

[11] 4,036,416

[45] July 19, 1977

[54] COMBINATION FOLDABLE GOLF CLUB CARRIER AND SCORE KEEPING DEVICE

[76] Inventor: Gerald W. Lowe, 9330 Tropico Drive, La Mesa, Calif. 92041

[21] Appl. No.: 655,856

[22] Filed: Feb. 6, 1976

[51] Int. Cl.[2] ..... B65D 69/00

[52] U.S. Cl. ..... 224/45 R; 35/31 E; 116/120; 116/135; 211/60 G

[58] Field of Search ..... 224/45 J, 45 Q; 280/33.99 A, DIG. 6; 211/60 G, 14, 198; 248/97; 150/1.5 R, 1.5 B; 35/31 E; 116/120, 135

[56] References Cited

U.S. PATENT DOCUMENTS

| | | | |
|---|---|---|---|
| 1,728,491 | 9/1929 | Janneson | 35/31 E |
| 2,211,635 | 8/1940 | Barteaux | 116/120 X |
| 2,598,798 | 6/1952 | Kerr | 211/198 X |
| 2,685,748 | 8/1954 | Gilbert | 35/31 E |
| 2,759,666 | 8/1956 | Wyckoff | 116/120 X |
| 2,962,827 | 12/1960 | Lachance et al. | 280/33.99 A |
| 2,990,865 | 7/1961 | Steele | 150/1.5 R |
| 3,128,021 | 4/1964 | Habbena | 211/14 X |
| 3,497,118 | 2/1970 | Najjar | 211/14 X |

FOREIGN PATENT DOCUMENTS

| | | | |
|---|---|---|---|
| 457,154 | 11/1936 | United Kingdom | 211/14 |
| 322,939 | 12/1929 | United Kingdom | 116/120 |

*Primary Examiner*—Robert J. Spar
*Assistant Examiner*—Donald W. Underwood

[57] ABSTRACT

A foldable, A-frame, compact golf club carrier, convenient to carry, stow, and transport; incorporating a score rule handle for fast and simple score keeping, and a novel split tube and tray for retaining golf balls.

2 Claims, 4 Drawing Figures

COMBINATION FOLDABLE GOLF CLUB CARRIER AND SCORE KEEPING DEVICE

Figure 1:
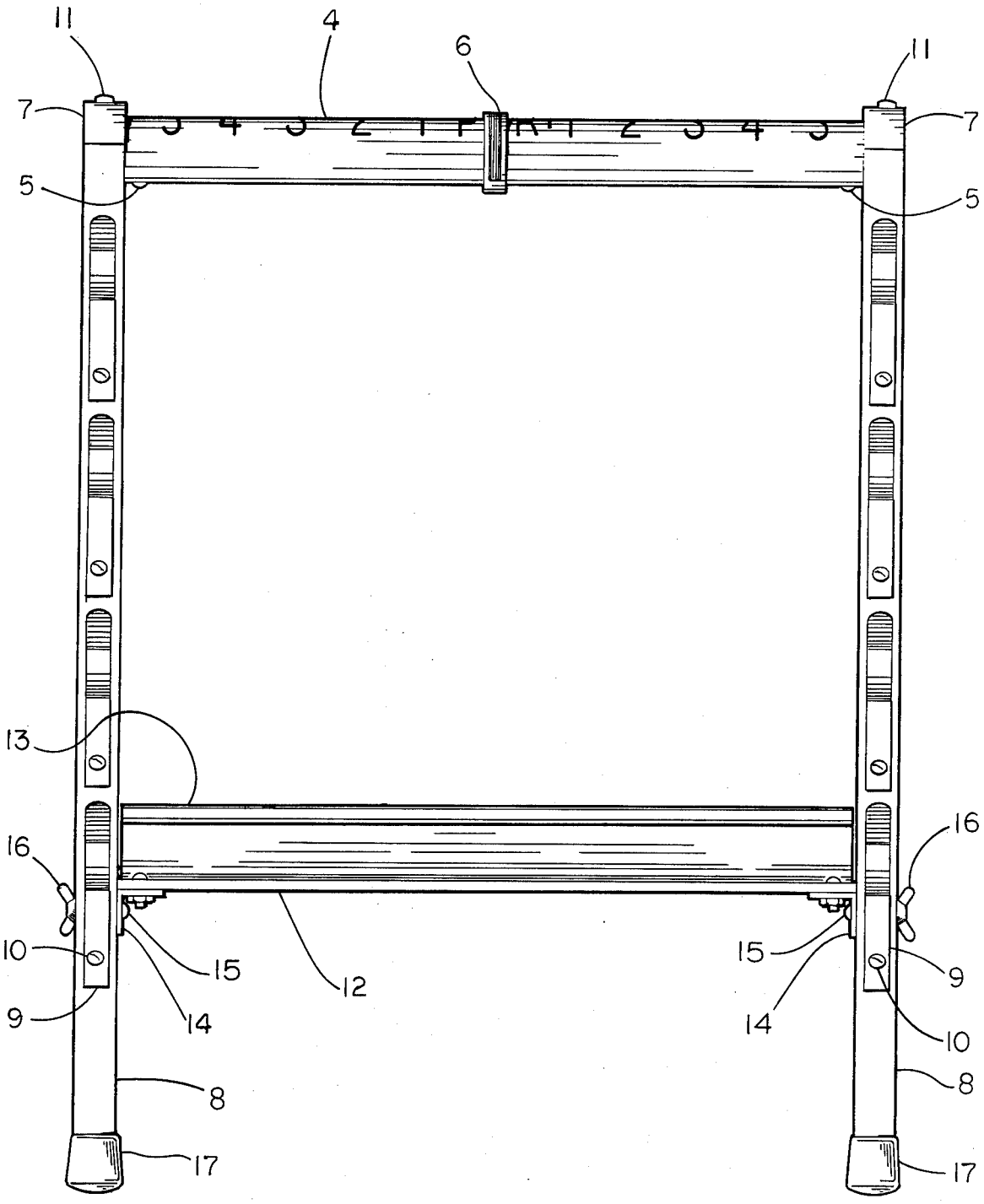

A practical golf club carrier weighing only 2 pounds or less, called by the inventor, the "Ee-Ze-Kar'i" Kad'i hereinafter to be referred to as the "Kad'i". Said Kad'i is comprised of three assemblies: a novel handle, utilized as a time-saving score keeping device; a foldable tray assembly which supports a unique soft plastic split tube for holding golf balls; and leg assemblies which pivot inward on a vertex block and fold into a closed parallel position when said tray assembly is raised.

An object of the invention is to provide a practical Kad'i which will offer the golfer a more leisurely game of golf because no more weight than is necessary is carried leisurely by the hand; time and steps are saved, thus the game of golf will become more relaxing and enjoyable.

Another object of the invention is to provide instant, over (or under) par, effortless, no paper or pencil, individual score keeping which is accomplished by just sliding a ring marker on the score rule which is utilized as the Kad'i handle; thus time is saved, conservation practiced and more leisure is gained for the golfer.

Another object of the invention is to provide an open carrier on which the clubs can be readily identified and 'by your side' where they can be conveniently snapped on and off the holding clips.

Another object of the invention is to provide an attractive, low cost carrier on which the clubs, themselves an object of beauty, can be brightly displayed and held by newly designed bright spring steel clips on a colorful A-frame, projecting an object of pride to the golfer, and a pleasant addition to the golf course.

An additional object of the invention is to provide instant identification and easy access to golf balls which are on display in a unique split plastic tube which holds the balls firmly on a colorful Plexiglas, or the like, tray.

An additional object of the Kad'i invention is to provide a compact carrier which is easier to transport to and from the golf courses than the present heavy burdensome golf bags and carts being used so extensively. By use of the Kad'i these unnecessary inconveniences are iliminated, since the ball tray assembly folds up, the legs fold in, thus the Kadi'i lies flat. Also the Kad'i, less clubs, weighing only 2 pounds can be stowed in a suitcase for distant travel.

An original idea and feature of the Kad'i is the new and easy way of individual score keeping on the score rule which involves the movement of the ring marker; the operation and use thereof will be fully described, and examples given under numeral 6 of the specification.

To facilitate understanding of the ½ scale drawings on three sheets, the numerals representing detail parts of the Kad'i will be described and grouped according to their respective assemblies of which there are three, and references will be made to the drawing Figures wherein like numerals denote like or corresponding parts throughout said drawings of which:

FIG. 1 is an elevational side view of the Kad'i invention, showing the embodiment of its three assemblies: the score rule assembly, the leg assemblies, and the golf ball holding tray assembly.

Figure 2:
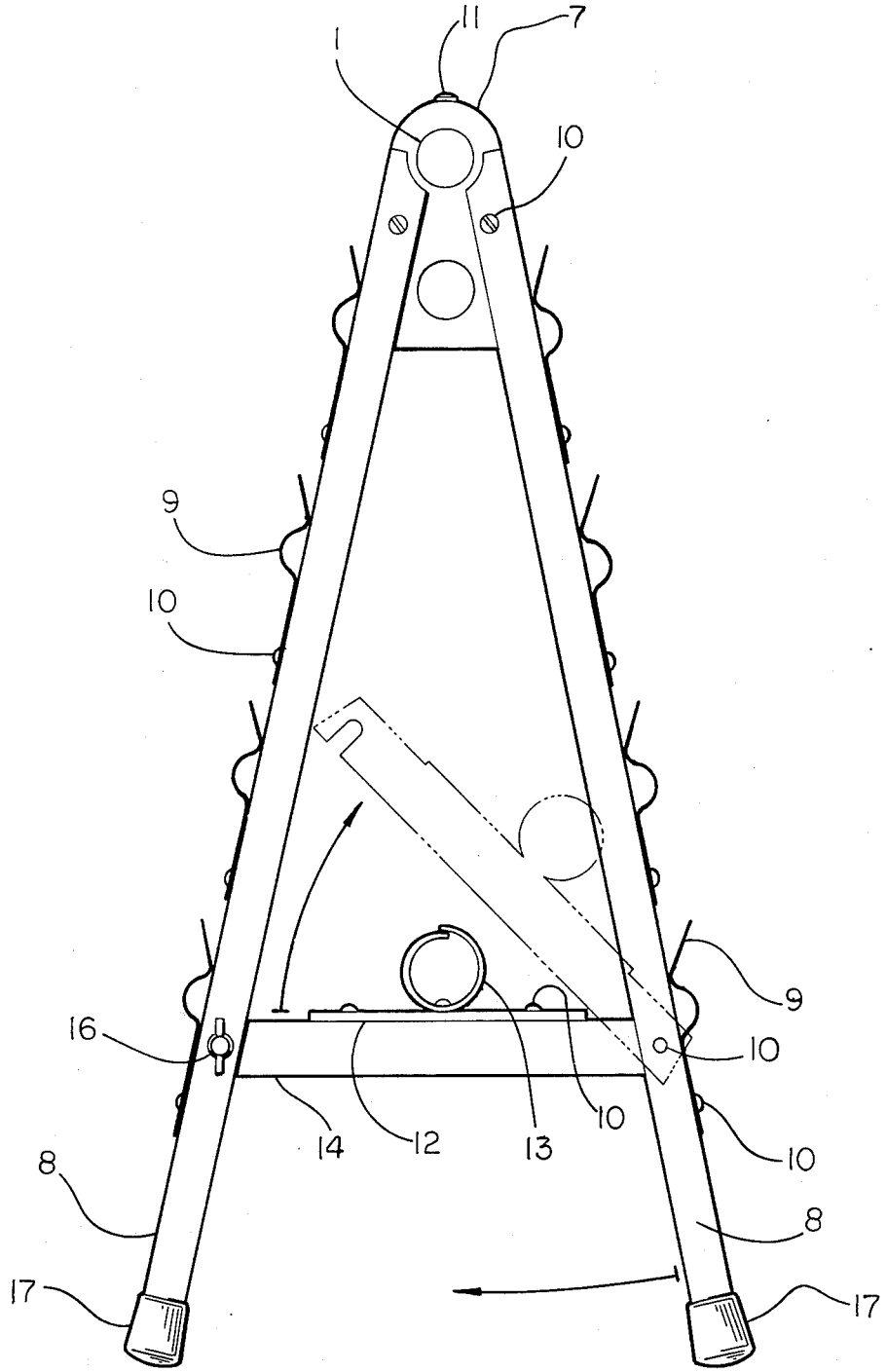

FIG. 2 is an elevational side view of the Kad'i exposing the A-frame configuration and showing in particular the movement of the tray assembly pivoting upward on fasteners 10 in the folding operation which when completed would make the tray assembly line up parallel to legs 8, thence said legs can be folded to a closed parallel position, pivots again being fasteners 10 in the vertex block 7. The soft plastic, split tube, golf ball holder 13 is shown in the normal contracted position, golf balls excluded. Golf balls are placed in either end of said split tube which expands and holds the balls as they are pushed further into said tube.

Golf club gripper clips 9 the original design of the inventor, are shown attached equally spaced to legs 8 by means of fasteners 10.

Figure 3:
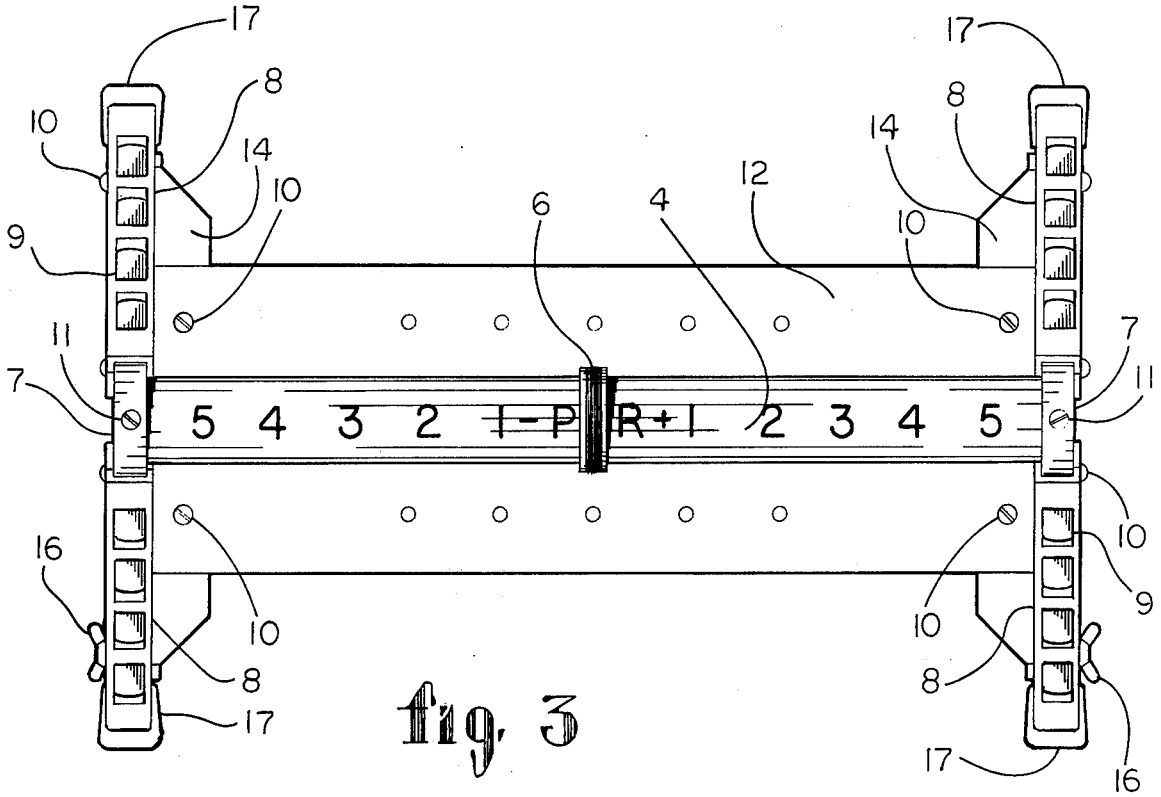

FIG. 3 is a plan view of the Kad'i. The score marker 6 is shown centrally located (on par) where it must always be placed at the start of nine holes of golf. Tray 12, with 10 holes for golf ball tees, is attached to angles 14 by means of fasteners 10.

Figure 4:
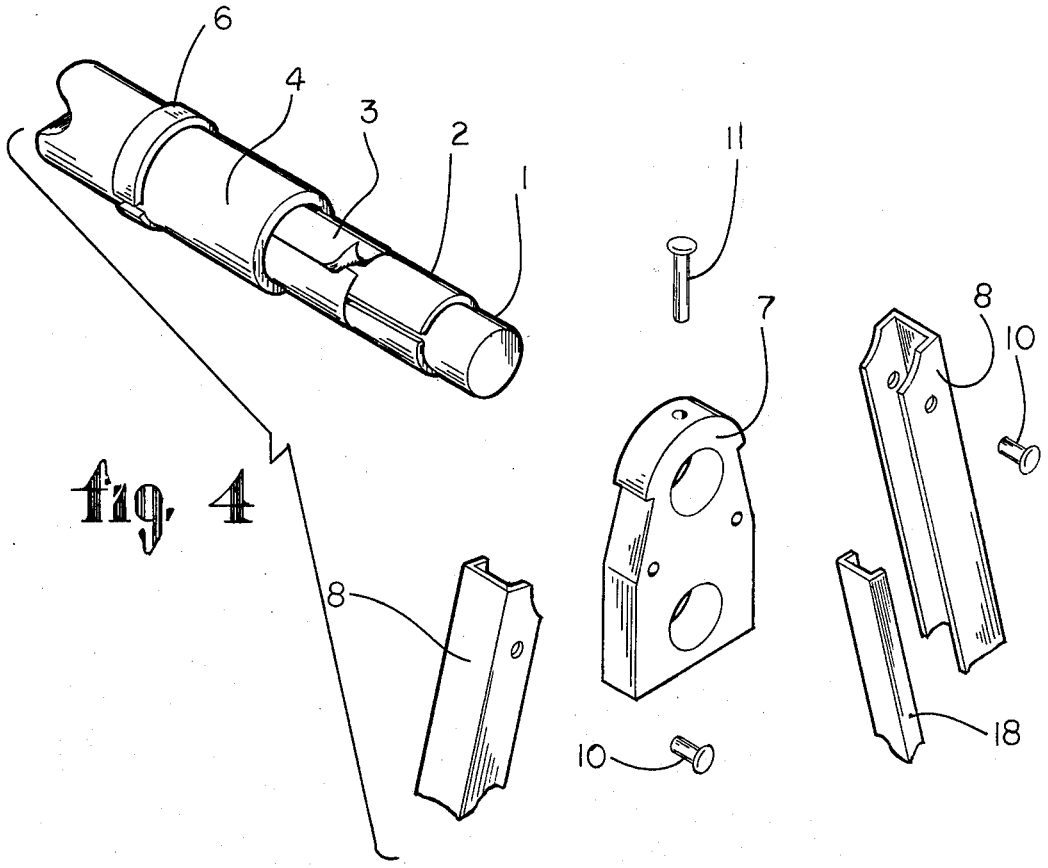

FIG. 4 is an expanded telescopic view of the score rule assembly, the true assembly view of which would show packing strip 2, score strip 3, and acrylic tube 4, identical in length. The lower portion of FIG. 4 is an exploded view of the vertex block 7 and legs 8; the true assembly view of which would show the inside surface of said channel leg resting on the 13° angled surface of said vertex block. Fasteners 10 are then inserted into matching holes to provide the pivot point necessary in the Kad'i Leg folding operation.

On final assembly, the ends of dowel 1 are inserted into vertex block 7 at which time fasteners 11 are screwed into tapped vertically drilled holes in each said vertex block and through said dowel.

Modification might be forthcoming to the present form of illustrated disclosure in order to conform to various methods of fastening, material enployment, and fabrication thereof: in this respect the inventor asks allowance for such be granted without departing from the original tenor or practical intent of the Kad'i invention as herein set forth.

The following numerals indicate parts which comprise the score rule handle assembly of the Kad'i invention:

1—(refer to FIGS. 2 & 4)

A dowel, of wood or other suitable material approximately ¾ inches in diameter and 13 inches in length. Said dowel serves as the inner core of the score rule handle.

2—(refer to FIG. 4)

A strip of thin packing; styrofoam or similar resilient material, is wraped around dowel 1 for the purpose of filling the slight gap between said dowel, and inner wall of tube 4.

3—(refer to FIGS. 3, 4, and score strip inclosed)

The score strip is a piece of quality paper or other suitable material about 2 inches in width and 12 inches in length, upon which is printed in bold type, a sequence of numbers cetered and equally spaced about the word " − PAR + ". The score strip is wrapped snuggly around dowel 1 and packing 2, and when this said trio is inserted into tube 4, the resiliatory action of said packing on said dowel presses the score strip smoothly against the inside wall of said tube.

4—(refer to FIGS. 1, 3, & 4)

A clear tube of acrylic, rigid plastic or other suitable material approximately ⅞ inches inside diameter and 12 inches in length, incloses the dowel 1, packing 2, and score strip 3.

5—(refer to FIG. 1)

A small wood screw, pin, or suitable fastener at each end of tube 4 keeps said tube from turning on dowel 1.

The fastener head must not interfere with the score marker 6 movement as it slides over said tube.

6—(refer to FIGS. 1, 3, & 4)

A split tube score marker of non-cracking butyrate, or the like, about 1 inch in length, and 1 inch inside diameter is used to slide over tube 4. The score marker may be wrapped on center with a narrow strip of thin contact tape, preferably rainbow, silver, or gold. Approximately ½ inch of the tape ends are turned in and pressed against the inside surface of the score marker tube to beautify and to accentuate its location in respect to the numbers on the score strip 3. Other methods could be used for marking the golf score, including the use of a rubber O-ring or the like.

OPERATION AND USE OF THE SCORE RULE AND MARKER

The golfer selects a constant par at the start of each nine holes of play (high scorers, or beginners must use a high par). The objective is to make as few moves as possible with the ring marker. Some golf courses do not have the same par for each hole; a constant par is always used regardless. All that is necessary to know is the total par for the course with which to compare your nine hole score.

e.g. A average golfer picks 4 as a constant par for his game. He sets the marker on par in the center of the score rule handle. After each hole in which he shoots his par 4, the marker is not moved. But after each hole where he goes over (or under) 4, he moves the marker accordingly: e.g. If the golfer has 5 strokes on the next hole, he moves the marker one number to the right, to + 1, which indicates 1 over par. If he then makes a hole in 2 strokes, he moves the marker back 2 places, to the left. The marker will then indicate that his score thus far is −1, or 1 under his par.

If during the course of the game his over (or under) par count happens to go over 5, the highest number on the score strip, he simply starts over again; in which case, 1 becomes 6, 2 becomes 7 etc. etc. This condition will seldom happen however when (through experience) the proper constant par is used.

At the end of each nine holes of play, the golfer knows his score immediately. It is 9 (holes) × (par) 4 = 36, plus (or minus) whatever the marker indicates. The golfer can then compare his score with the specified par of the course.

The following numerals indicate parts which comprise the leg assemblies of the Kad'i:

7—(refer to FIGS. 1, 2, 3, & 4)

The vertex block is made of Plexiglas or other, or suitable plastic compound in the event of the injection mold method of manufacturing is applied. By means of a fastener 10, channel legs 8 pivot on the block from a fixed open angle position of about 26° to a closed parallel position. The radius ends of the block are stepped 1/16 of an inch, or the thickness of the said channel leg to allow a smooth outer surface at the joint of said leg and vertex block. The top hole, ¾ inches in diameter in the block is the receptacle for dowel 1. A self tapping machine screw fastener 11 or the like, holds the tapped vertex block firmly to dowel 1. The lower ¾ inch hole in the block is merely an accessory hole.

8—(refer to FIGS. 1, 2, 3, & 4)

Legs of the kad'i are satin anadized aluminum ½ inch channel pieces of about 16 inches in length. Various lengths and other forms and materials may be used instead, including those suitable for the injection mold process.

9—(refer to FIGS. 1, 2, & 3)

The clips, which grip the golf clubs and which are the original design of the inventor are made of ½ inch wide bright spring steel, 0.025 inches in thickness. Other suitable materials may be used instead, including plastics in case of the injection mold process. The clips are equally spaces on each of the four legs 8. The number of clips used and the length of said legs may vary according to the manufacturer's choice of the number of golf clubs to be carried. The clips are secured to leg 8 by fasteners 10.

10—(refer to FIGS. 1, 2, 3, & 4)

Fasteners used are truss head machine screws, preferably No. 8 × ½ inches in length, accompanied with lock or flat washers and nuts as required. They are used mainly for the attachment of clips 9, and are also used for attaching forthcoming tray assembly to the leg assemblies. Other suitable fasteners, such as rivets, pins, or various type screws may be used in place of the above.

15—(refer to FIG. 1)

A No. 10 machine screw, pin or other, 1 inch in length which is inserted through holes in the channel leg 8 with threads protruding on the outside of said leg to receive wing nut 16.

16—(refer to FIGS. 1, 2, & 3)

A wing nut which when tightened holds the aforesaid tray assembly in the horizontal position, or when loosened relieves said tray assembly to fold upward.

17—(refer to FIGS. 1, 2, & 3)

Soft plastic or rubber protective tips which are pressed on to the bottom ends of the legs 8.

18—(refer to FIG. 4)

A short-leg - channel filler, an optional item, which for the purpose of cost reduction, may be omitted. The filler may be pressed into the channel legs 8 thus changing configuration of said leg into a square-tubular leg thus projecting a closed-in appearance.

11—(refer to FIGS. 1, 2, 3, & 4)

A self tapping machine screw about 1¼ inches in length, or other suitable fastener, holds each of the two vertically tapped vertex blocks 7 firmly to the dowel 1 ends.

Numeral 11 is a common assembly item used only to secure the two afore described assemblies together.

The following numerals indicate parts which comprise the golf ball tube and tray assembly:

12—(refer to FIGS. 1, 2, & 3)

A tray of colored (preferably light blue) plexiglas sheet about ⅛ inch thick. Other suitable materials and colors may be used instead. Five or more holes are drilled along each side of the tray for the purpose of holding color matching golf tees.

13—(refer to FIGS 1 & 2)

A length of soft plastic tube, preferably the standard 1¼ In. diameter thin wall type used for holding golf clubs in bags. The tube is split in a straight line along the top, causing a slight over lap and diameter reduction which holds golf balls in place. Fasteners 10 hold the tube along the center of the tray 12.

14—(refer to FIGS. 1, 2, & 3)

A ¾ inch angle of satin anadized aluminum, or the like 1/16 inch thick and 6¾ inches in length is secured to tray 12 by means of two fasteners 10.

One end of each angle is attached to leg 8 by means of a fixed fastener 10 and serves as a pivot to fold tray 12 upward, an operation which precedes the folding of the said legs inward.

The opposite ends of the angles are notched for the purpose of holding the tray assembly to leg 8 by means of protruding machine screw 15 and wing nut 16.

A limited number of tubular golf club carriers are currently seen on golf courses but they lack the combined advantages of foldability and the incorporation of a fast score keeping device.

The conventonal method of playing golf involves the toting of heavy bags containing relatively light clubs, but since the shoulder strapped bag is usually too heavy to tote, a two-wheeled chariot contraption is employed to tote the big bag, and this combination is carted around the golf courses and often has to be parked or disobligingly detoured around sand traps, and rough or hilly ground, causing a lot of ziz-zag treading across the terrain, and also, 'off the course' handling, stowing and transporting of this bulky equipment in current economically compact cars, creates a chronic chore frequently requiring the magical maneuvering of a golfin' Houdini.

While the Kad'i herein disclosed, illustrated, and described is at times confined to certain structural details, I do not wish to limit myself to such details but desire to cover other forms and materials which come within the scope of my invention and the following claims.

I claim:

1. A foldable A-frame device designed to relieve the golfer of inconveniences caused by unnecessarily heavy and bulky conventional golfing equipment; a device which is easy to carry around the golf courses and convenient to handle when stowing and transporting to and from the golf course; a structure consisting primarily of two identical A-frame assemblies, each assembly containing a vertex block (7) with a hole to receive and secure by means of fasteners (11) an extended dowel (1) end of a handle, each said vertex block having tapered sides, the tapered sides of said vertex blocks slip fitting into aluminum channel legs (8) and each vertex block held accurately by one fastener (10) on which said legs can be pivoted from a 13° open angle, to an inward 0° closed position in which case said legs would lie parallel to each other, and each leg consisting of four (more or less may be used according to manufacturers discretion) accurately formed thin spring steel gripper clips (9) attached by fasteners (10) equally spaced vertically and aligned so that the horizontally positioned golf clubs can be easily inserted, securely held within the clip radii, and easily identified and snapped vertically on and off said clips, and in addition a golf ball tube and tray assembly maintains the proper spacing between the two A-frames and it consists of a length of split plastic tube (13) which is used as a new type of receptacle for retaining golf balls and said tube is centrally attached to a tray (12) on which angles (14) serve as horizontal cross members to brace and rigidify the A-frame assemblies, one end of each said angle being attached to channel legs (8) by means of fasteners (10) which serves as a pivot to fold said tray assembly upward, an operation which precedes the folding of said channel legs (8) inward to the closed parallel position, opposite ends of said angles being notched for the purpose of locking said tray assembly into the open position by means of locating screws (25) and wing nuts (16) respectively, and finally it should be noted that if golf clubs are intact when said golf ball tube and tray assembly is folded upward, one club will interfere with said golf ball tube and must be removed from this position in order to achieve complete closure of said legs.

2. The device of claim 1 wherein the handle further includes a scorekeeping device for the average golfer, on which only a few strokes are necessary to be counted a device which indicates only the number of strokes over (or under) a chosen constant par, a device on which only a limited sequence of numerals is necessary, a device which renders the use of score cards and pencils unnecessary, thus providing a fast and easy method of score keeping a device not to be carried separately but which is an integral part of the A-frame golf club carrier: the handle which is also the score keeping assembly which consists principally of a dowel (1) wrapped with a score strip (3) portraying a sequence of numerals inclosed in a clear acrylic tube (4) and mounted with a slidable ring (6) for the purpose of fascilitating score keeping by instant indication of the number of an individual golfer's strokes over (or under) his chosen constant par.

* * * * *

UNITED STATES PATENT OFFICE

CERTIFICATE OF CORRECTION

Patent No. 4,036,416 Dated July 19, 1977

Inventor(s) Gerald W. Lowe

It is certified that error appears in the above-identified patent and that said Letters Patent are hereby corrected as shown below:

Column 6, line 20, "(25)" should read --(15)--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*